US011590562B2

(12) United States Patent
Tanigawa

(10) Patent No.: US 11,590,562 B2
(45) Date of Patent: Feb. 28, 2023

(54) CASTING MOLD

(71) Applicant: TOYOTA JIDOSHA KABUSHIKI KAISHA, Toyota (JP)

(72) Inventor: Hiroaki Tanigawa, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/559,077

(22) Filed: Dec. 22, 2021

(65) Prior Publication Data

US 2022/0241846 A1 Aug. 4, 2022

(30) Foreign Application Priority Data

Feb. 4, 2021 (JP) ..... JP2021-016260

(51) Int. Cl.
*B22C 9/06* (2006.01)
*B22C 9/10* (2006.01)

(52) U.S. Cl.
CPC ..... *B22C 9/064* (2013.01)

(58) Field of Classification Search
CPC ..... B22C 9/06; B22C 9/064; B22C 9/10; B22C 9/103; B22C 9/108
USPC ..... 164/302, 369
See application file for complete search history.

(56) References Cited

U.S. PATENT DOCUMENTS 2,256,769 A * 9/1941 Amrine ..... B29C 43/18 16/431
2001/0008182 A1* 7/2001 Sugita et al. ..... B22C 9/06 164/112
2004/0094285 A1* 5/2004 Yamaguchi et al. ... B22D 17/24 164/112

FOREIGN PATENT DOCUMENTS

JP 2013-132685 A 7/2013
JP 2013-146767 A 8/2013
JP 2013-176784 A 9/2013

* cited by examiner

*Primary Examiner* — Kevin P Kerns
(74) *Attorney, Agent, or Firm* — Oliff PLC

(57) ABSTRACT

A casting mold includes: an upper mold; a lower mold; a horizontal mold; and a core. The core includes a main body part, and a baseboard part that continues to the main body part. The lower mold includes an accommodation part that accommodates the baseboard part. The casting mold further includes an urging member that urges the baseboard part toward an inner face of the accommodation part.

4 Claims, 2 Drawing Sheets

CASTING MOLD

CROSS REFERENCE TO RELATED APPLICATIONS

This application is based upon and claims benefit of priority from Japanese Patent Application No. 2021-16260, filed on Feb. 4, 2021, the entire contents of which are incorporated herein by reference.

BACKGROUND

Field

The present disclosure relates to a casting mold.

Related Art

Conventionally, a core has been used to form an opening part or a cavity inside a product manufactured by casting. The core is fixed to a mold such that part of the core is arranged in the cavity into which a molten metal of a metal such as aluminum flows. Generally, a core is formed using sand and a resin, and has a lower specific gravity than a molten metal, and therefore is applied a buoyance in the molten metal. To prevent positional displacement of a core due to such a buoyance, it has been proposed to appropriately manage clearances between a baseboard part which is a part of the core fixed to a mold, and an accommodation part which accommodates the baseboard part in a lower mold (see JP2013-76784A).

A configuration according to JP2013-176784A has a problem that it is difficult to appropriately manage the clearance between the baseboard part and the accommodation part of the lower mold. An operator needs to appropriately set clearances by taking into account, for example, hot deformation of a lower mold, a manufacturing variation of the baseboard part and the lower mold, a variation of a posture at a time when the baseboard part is accommodated, and aging due to wear of the lower mold, and therefore has been forced to bear a heavy burden to the operator. Furthermore, the operator needs to adjust the clearances on a regular basis, and therefore has been forced to bear a heavy burden in this regard, too.

SUMMARY

One aspect of the present disclosure provides a casting mold which includes: an upper mold; a lower mold; a horizontal mold; and a core. In this casting mold, the core includes a main body part, and a baseboard part which continues to the main body part, the lower mold includes an accommodation part which accommodates the baseboard part, and the casting mold further includes an urging member which urges the baseboard part toward an inner face of the accommodation part.

DETAILED DESCRIPTION

A. Embodiment:

A1. Device Configuration

Figure 1:
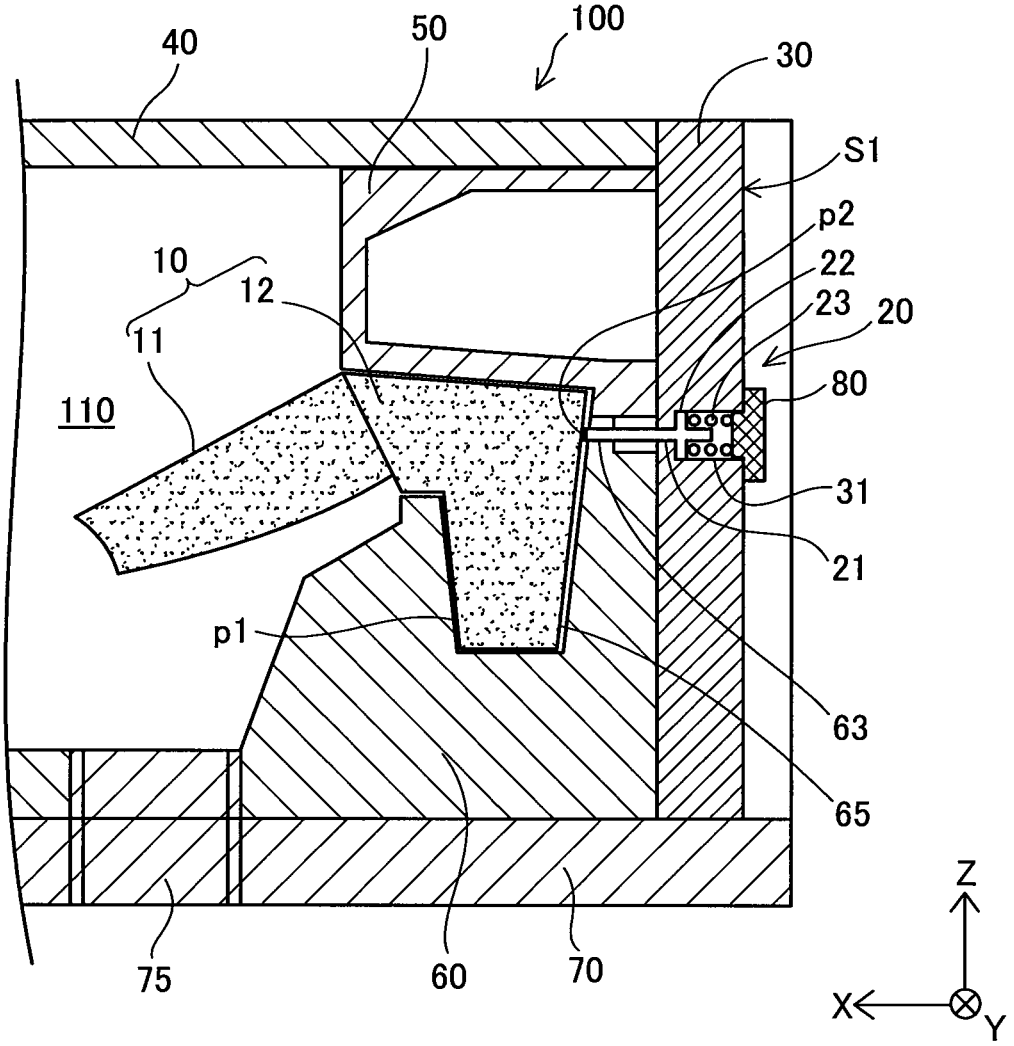
FIG. 1 is a cross-sectional view illustrating a configuration of a casting mold according to one embodiment of the present disclosure.

FIG. 1 is a cross-sectional view illustrating a configuration of a casting mold 100 according to one embodiment of the present disclosure. The casting mold 100 is used to cast a cylinder head. FIG. 1 illustrates an X axis, a Y axis and a Z axis which are orthogonal to each other in addition to the casting mold 100. The X axis and the Y axis are parallel to a horizontal face. The Z axis is parallel to a vertical direction. A +Z direction is an upper vertical direction, and a −Z direction is a lower vertical direction. The X axis, the Y axis and the Z axis of another figure (FIG. 2) correspond to the X axis, the Y axis and the Z axis of FIG. 1. In the present embodiment, an "X axis direction" means a generic term of a +X direction and a −X direction. Similarly, a "Y axis direction" means a generic term of a +Y direction and a −Y direction, and a "Z axis direction" means a generic term of the +Z direction and the −Z direction. In addition, FIG. 1 illustrates only part of the casting mold 100 including a part at which an intake port is formed, and other parts (parts on a left side in FIG. 1) are omitted for ease of illustration.

The casting mold 100 includes an upper mold 40, a lower mold 60, a horizontal nest 50, a plate member 30, a core 10, an urging member 20 and a cap member 80. The upper mold 40, the lower mold 60 and the horizontal nest 50 form a cavity 110 for forming the cylinder head. An aluminum alloy molten metal is loaded in this cavity 110. In addition, the molten metal is not limited to the aluminum alloy, and molten metals of other arbitrary types may be loaded. In the present embodiment, each of the upper mold 40, the lower mold 60, the horizontal nest 50 and the plate member 30 is formed using steel.

The upper mold 40 is arranged at an end part in the +Z direction of the casting mold 100 to form an upper end part of the cylinder head.

The lower mold 60 is arranged at an end part in the −Z direction of the casting mold 100 to form a lower end part of the cylinder head and a lower side end part of the cylinder head. The lower mold 60 is placed on a base 70. A molten metal supply hole 75 which penetrates in a thickness direction is formed in the base 70. One end of the molten metal supply hole 75 continues to the cavity 110, and the molten metal is supplied to the cavity 110 through the molten metal supply hole 75. Furthermore, an upper end part of the lower mold 60 has a portion which protrudes in the +Z direction, and a first through-hole 63 which penetrates in the X axis direction is formed at this portion. Part of the urging member 20 (a distal end part of a pin member 21 described below) is inserted in the first through-hole 63. An accommodation part 65 is formed in the lower mold 60. Part of the core 10 (a baseboard part 12 described below) is accommodated in the accommodation part 65. The accommodation part 65 is configured as a bottomed hole whose end part in the +Z direction is opened and which is formed to extend in the Z axis direction. The accommodation part 65 has a cup-like outline shape whose cross-sectional area becomes smaller toward the −Z direction.

The horizontal nest 50 is sandwiched and arranged between the upper mold 40 and the lower mold 60 to form an upper side end part of the cylinder head. The plate member 30 is arranged at an end part in the −X direction of the casting mold 100. A face in the +X direction of the plate member 30 is in contact with an end face in the −X direction of the lower mold 60, and an end face in the −X direction of the horizontal nest 50. The plate member 30 supports the horizontal nest 50 and the lower mold 60 from the horizontal direction. The plate member 30 is connected to the horizontal nest 50, and is also referred to as a connecting plate. A member in a state where the horizontal nest 50 and the plate member 30 are connected is also referred to as a horizontal mold. A stepped second through-hole 31 which penetrates in the thickness direction is formed in the plate member 30. The second through-hole 31 is configured by a part (small diameter part) whose diameter positioned in the +X direction is small, and a part (large diameter part) whose diameter positioned in the −X direction is large. Part of the urging member 20 (a rear end part of the pin member 21 described below and a spring 23 described below) is inserted in the second through-hole 31. The second through-hole 31 communicates with a first through-hole 63 formed in the above-described lower mold 60.

The core 10 is formed by a material made of sand and a resin material for solidification. The core 10 is used to form the intake port of the cylinder head. The core 10 includes a main body part 11 and a baseboard part 12 which continues to the main body part 11, and adopts a structure formed by integrally forming the main body part 11 and the baseboard part 12.

Figure 2:
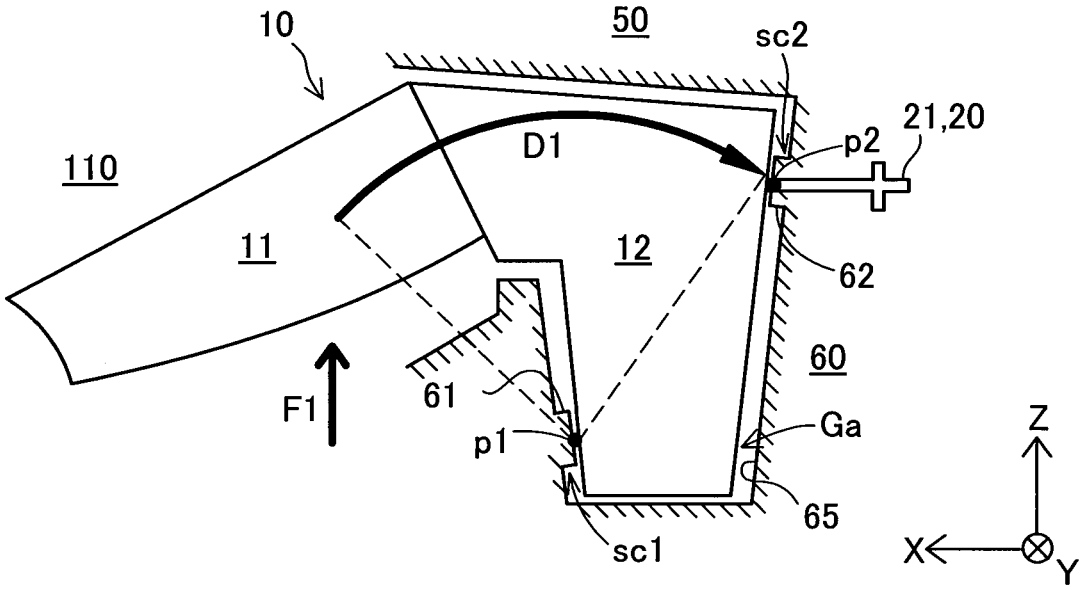
FIG. 2 is an explanatory view schematically illustrating a detailed configuration of a core and an accommodation part.

FIG. 2 is an explanatory view schematically illustrating a detailed configuration of the core 10 and the accommodation part 65. Part of the components of the casting mold 100 such as the upper mold 40, part of the lower mold 60, the plate member 30 and the base 70 are omitted in FIG. 2.

As illustrated in FIGS. 1 and 2, the main body part 11 is arranged in the cavity 110 to form the intake port. The main body part 11 has a tapered columnar shape which has a longitudinal direction. The longitudinal direction of the main body part 11 is a direction which is inclined with respect to a horizontal direction and a vertical direction. In other words, the main body part 11 is arranged in the cavity 110 so as to be positioned in the +Z direction toward the −X direction. End parts in the −X direction and the +Z direction of the main body part 11 continue to an upper end part of the baseboard part 12.

The baseboard part 12 is used to fix the core 10 to the mold (lower mold 60). The baseboard part 12 is a columnar member which has a tapered cross-sectional shape whose upper end part is the largest and which becomes smaller toward the −Z direction. The baseboard part 12 is accommodated in the accommodation part 65.

As illustrated in FIG. 2, two small clearance parts (a first small clearance part sc1 and a second small clearance part sc2) are included in a gap Ga between an inner face of the accommodation part 65 and an outer face of the baseboard part 12. The first small clearance part sc1 is positioned on an inner side in the horizontal direction and a lower side in the vertical direction, in other words, in the +X direction and the −Z direction in the gap Ga. The second small clearance part sc2 is positioned on an outer side in the horizontal direction and an upper side in the horizontal direction, in other words, in the −X direction and the +Z direction in the gap Ga. The two small clearance parts sc1 and sc2 have small distances between the inner face of the accommodation part 65 and the outer face of the baseboard part 12 compared to other parts of the gap Ga. These two small clearance parts sc1 and sc2 are realized by two protrusion parts (a first protrusion part 61 and a second protrusion part 62) formed on the lower mold 60. The first protrusion part 61 is positioned on an inner side in the horizontal direction and a lower side in the vertical direction, in other words, in +X direction and the −Z direction in the accommodation part 65. The second protrusion part 62 is positioned on an outer side in the horizontal direction and an upper side in the vertical direction, in other words, in the −X direction and the +Z direction in the accommodation part 65. The two small clearance parts sc1 and sc2 prevent positional displacement of the baseboard part 12 in the accommodation part 65. More specifically, the two small clearance parts sc1 and sc2 have the small distances between an inner side surface of the accommodation part 65 and an outer side surface of the baseboard part 12, i.e., the small distances along the X axis direction compared to the other parts, so that it is possible to prevent the positional displacement of the baseboard part 12 along the X axis direction. Furthermore, the distances between the inner side surface of the accommodation part 65 and the outer side surface of the baseboard part 12 are small compared to the other parts, so that the baseboard part 12 and the accommodation part 65 readily come into contact, and a friction force prevents the baseboard part 12 from being displaced in the vertical direction (Z axis direction).

The urging member 20 urges the baseboard part 12 toward the inner face of the accommodation part 65. As illustrated in FIG. 1, the urging member 20 is arranged across the first through-hole 63 formed in the lower mold 60, and the second through-hole 31 formed in the plate member 30. As illustrated in FIG. 1, the urging member 20 includes the pin member 21 and the spring 23.

The pin member 21 has a rod-like external shape, and is arranged such that the longitudinal direction is parallel to the X axis direction. In the present embodiment, the pin member 21 is formed using steel. In this regard, the pin member 21 is not limited to the steel, and may be formed using an arbitrary material such as a resin or ceramics. Part on an end part side in the +X direction of the pin member 21 is accommodated in the first through-hole 63. An end in the +X direction of the pin member 21 has a semispherical external shape, and is in contact with the baseboard part 12. As illustrated in FIG. 2, the pin member 21 comes into contact with the baseboard part 12 through the second small clearance part sc2. The end in the +X direction of the pin member 21 is configured in the semispherical shape, so that it is possible to place the baseboard part 12 and the pin member 21 in contact in a very narrow area (so-called one point). Consequently, it is possible to substantially fix a contact position irrespectively of a posture of the baseboard part 12 and a posture of the pin member 21, and press the baseboard part against the accommodation part with a stable urging force.

As illustrated in FIG. 1, a flange part 22 is formed at a position close to the end part in the −X direction the pin member 21. The flange part 22 and a part on the −X direction side of the flange part 22 of the pin member 21 are accommodated in the second through-hole 31. The flange part 22 is accommodated in a large diameter part of the second through-hole 31. A size of a diameter of a small diameter part of the second through-hole 31 is smaller than diameters of other parts of the pin member 21 except the flange part 22. Hence, movement of the flange part 22 in the X direction is restricted. The spring 23 is configured as a coil spring in the present embodiment. An end part in the +X direction of the spring 23 is in contact with an end face in the −X direction of the flange part 22. On the other hand, an end part in the −X direction of the spring 23 is in contact with an end surface in the +X direction of the cap member 80. The spring 23 urges the pin member 21 toward the +X direction. Thus, a distal end in the +X direction of the pin member 21 is in contact with the baseboard part 12, and urges the baseboard part 12 toward the +X direction (toward the inner face of the accommodation part 65). In this regard, such a spring constant that the baseboard part 12 is not damaged upon contact (urging) of the pin member 21 is specified by, for example, an experiment in advance, and a spring having the specified spring constant is adopted as the spring 23. Furthermore, a stroke amount which does not bottom is specified as a stroke amount of the spring 23 by, for example, an experiment in advance, and a length in the X axis direction of the second through-hole 31 is set based on the specified stroke amount.

As described above, the pin member 21 is urged toward the +X direction by the spring 23, so that it is possible to place the pin member 21 in contact with the baseboard part 12 at all times. Even when, for example, the core 10 is repeatedly taken out and put in, and therefore the lower mold 60 wears and the shape of the accommodation part 65 changes from an initial state, it is possible to place the pin member 21 in contact with the baseboard part 12. Furthermore, even when the distal end of the pin member 21 wears and ages from the initial state, it is possible to place the pin member 21 in contact with the baseboard part 12. Furthermore, even when the shape of the baseboard part 12 and, particularly, a dimension in the X axis direction of an upper part of the baseboard part 12 are not fixed due to a manufacturing variation of the core 10, it is possible to place the pin member 21 in contact with the baseboard part 12.

As illustrated in FIG. 1, the cap member 80 seals an opening on a side opposite to the side of the second through-hole 31 which continues to the first through-hole 63, in other words, an opening at the end part in the −X direction of the second through-hole 31. The cap member 80 comes into contact with an end in the −X direction of the spring 23, accepts a stress from the spring 23, and applies a reaction force to the spring. In the present embodiment, the cap member 80 is formed using steel. In this regard, the cap member 80 is not limited to the steel, and may be formed using an arbitrary material such as a resin or ceramics.

In addition, although illustration is omitted, parts of the casting mold 100 whose illustration is omitted, i.e., parts omitted on the left side in FIG. 1 also employ the same configuration as the above-described configuration on the right side.

A2. Assembly Procedure of Casting Mold 100:

First, the lower mold 60 is placed on the base 70. The baseboard part 12 of the core 10 is accommodated in the accommodation part 65. The horizontal nest 50 and the upper mold 40 are arranged. The plate member 30 is arranged on the side surface. The urging member 20 is accommodated in the first through-hole 63 and the second through-hole 31. The opening of the second through-hole 31 is sealed by the cap member 80. An outer face S1 of the plate member 30 is pressed in the X axis direction by an unillustrated cylinder to clamp. By this means, the urging member 20 urges the baseboard part 12 toward the inner face of the accommodation part 65, so that positional displacement of the baseboard part 12 in the accommodation part 65 is prevented. Consequently, even when the molten metal is subsequently loaded to the cavity 110 and the main body part 11 is applied the buoyance from the molten metal, the positional displacement of the core 10 is prevented.

A3. Effect Provided by Arrangement Position of Urging Member 20:

As described above, when the urging member 20 urges the baseboard part 12 toward the inner face of the accommodation part 65, the positional displacement of the baseboard part 12 in the accommodation part 65 is prevented. Furthermore, the two small clearance parts sc1 and sc2 are also formed, so that the positional displacement of the baseboard part 12 in the accommodation part 65 is prevented. These effects will be described in more detail with reference to FIG. 2.

One end in the longitudinal direction of the main body part 11 is connected to the upper end part of the baseboard part 12. Hence, when a buoyance F1 of the molten metal is applied to the main body part 11 in the +Z direction as illustrated in FIG. 2, the baseboard part 12 tries to rotate in a rotation direction D1 indicated by a bold arrow about a vicinity of the end part in the +X direction and the −Z direction. At this time, a point p1 which is the rotation center is near the first protrusion part 61 which forms the small clearance part sc1. Furthermore, a point p2 at which the urging member 20 (pin member 21) is in contact with the baseboard part 12 is near the end part in the −X direction and the +Z direction of the baseboard part 12. Consequently, at the point p2 which is significantly apart from the point p1 which is the rotation center, the baseboard part 12 is urged toward a direction substantially opposite to the rotation direction D1, it is possible to more reliably prevent rotation of the baseboard part 12 with a smaller force.

The casting mold 100 according to the above-described embodiment includes the urging member 20 which urges the baseboard part 12 toward the inner face of the accommodation part 65, so that it is possible to press the baseboard part 12 against the accommodation part 65. Consequently, it is possible to prevent the positional displacement of the core 10 due to the buoyance of the molten metal by using the friction force between the baseboard part 12 and the accommodation part 65, easily prevent the positional displacement of the core 10, and reduce an operator's burden.

Furthermore, the urging member 20 includes the pin member 21, and the spring 23 which urges the pin member 21 toward the baseboard part 12, so that, even when the lower mold 60 and the pin member 21 age due to, for example, wear, it is possible to continuously press the baseboard part 12 against the accommodation part 65. Consequently, it is possible to reduce an operator's burden required for maintenance.

Furthermore, the external shape of the one end of the pin member 21 which is in contact with the baseboard part 12 has the semispherical shape, so that it is possible to place the baseboard part 12 and the pin member 21 in contact in the very narrow area (so-called one point). Consequently, it is possible to substantially fix the contact position irrespectively of the posture of the baseboard part 12 and the posture of the pin member 21, and press the baseboard part 12 against the accommodation part 65 with a stable urging force.

Furthermore, after the baseboard part 12 is accommodated in the accommodation part 65 and each of the molds 40, 50 and 60 is closed, the pin member 21 can be inserted in the first through-hole 63 and the second through-hole 31 through the opening of the plate member 30 to seal the opening by the cap member 80. Consequently, it is possible to avoid the pin member 21 from bothering accommodating the baseboard part 12 in the accommodation part 65.

Furthermore, the protrusion parts 61 and 62 for forming the small clearance parts sc1 and sc2 are formed on the accommodation part 65, so that, by using the small clearance parts sc1 and sc2, it is also possible to prevent the positional displacement of the baseboard part 12 in the accommodation part 65, and prevent the positional displacement of the core 10. Furthermore, the size of the clearance is relatively large at the part other than the small clearance parts sc1 and sc2 of the gap Ga, so that it is possible to improve operability for accommodating the baseboard part 12 in the accommodation part 65.

The upper end part of the baseboard part 12 is connected with the one end in the longitudinal direction of the main body part 11, the buoyance of the molten metal tries to rotate the core about the inner side in the horizontal direction and the lower side in vertical direction (point p1) of the baseboard part 12 as the rotation center such that the outer side in the horizontal direction and the upper side in the vertical direction of the baseboard part travel downward. However, according to the casting mold 100 of the present embodiment, the pin member 21 comes into contact with the baseboard part 12 through the clearance part sc2 on the outer side in the horizontal direction and the upper side in the vertical direction side of the gap Ga, so that it is possible to more reliably prevent such rotation with a small force.

B. Other Embodiment:

(B1) In the above embodiment, the urging member 20 is configured by the pin member 21 and the spring 23. However, the present disclosure is not limited to this configuration. An arbitrary configuration which can press the baseboard part 12 against the inner face of the accommodation part 65 may be employed as the configuration of the urging member 20. For example, instead of the spring 23 formed as the coil spring, a spring configured as a leaf spring may be used. Furthermore, instead of the spring, an elastic body of an arbitrary type having high heat resistance may be used. Furthermore, the urging member 20 may be configured only by the spring. These configurations also provide the same effect as that of the embodiment.

(B2) In the above embodiment, the end in the +X direction of the pin member 21 has the semispherical external shape. However, the present disclosure is not limited to this configuration. The end in the +X direction of the pin member 21 may have an arbitrary external shape such as a planar external shape or a recessed external shape which can apply a stress to the baseboard part 12.

(B3) In the above embodiment, part of the urging member 20 is accommodated in the second through-hole 31 formed in the plate member 30. However, the present disclosure is not limited to this configuration. For example, a position and a size of a through-hole of the lower mold 60 may be changed to form as a through-hole which can accommodate the entire urging member 20, and accommodate the urging member 20 in this through-hole. Furthermore, by sealing an opening of this through-hole by the cap member 80, the same effect as that of the above embodiment is provided.

(B4) In the above embodiment, the small clearance parts sc1 and sc2 are formed by the protrusion parts 61 and 62 formed on the accommodation part 65. However, the present disclosure is not limited to this configuration. Instead of the protrusion parts 61 and 62 or in addition to the protrusion parts 61 and 62, protrusion parts may be provided to the baseboard part 12, and these protrusion parts may form the small clearance parts sc1 and sc2. This configuration also provides the same effect as that of the above embodiment. Furthermore, contrary to this configuration, the small clearance parts sc1 and sc2 may be omitted in the above embodiment. In this configuration, too, the urging member 20 urges the baseboard part 12 toward the inner face of the accommodation part 65, so that the same effect as that of the above embodiment is provided.

(B5) In the above embodiment, the pin member 21 comes into contact with the baseboard part 12 through the second small clearance part sc2. However, the present disclosure is not limited to this configuration. The pin member 21 may come into contact with the baseboard part 12 through a part different from the second small clearance part sc2 of the gap Ga. In this case, a position of the baseboard part 12 which the pin member 21 comes into contact with may be on the outer side in the horizontal direction and not on the upper side in the vertical direction. The position may be on, for example, the outer side in the horizontal direction and at a center or on a lower side in the vertical direction.

(B6) In the above embodiment, the pin member 21 is in contact with the side surface of the baseboard part 12, yet may be in contact with the upper face instead of the side face. According to this configuration, through-holes which accommodate the urging member 20 may be formed in the horizontal nest 50 and the upper mold 40, the pin member 21 may be urged from the upper side to the lower side, and the baseboard part 12 may be urged downward. According to this configuration, the baseboard part 12 is pressed against a face on the lower side (bottom face) of the inner face of the accommodation part 65. This configuration also provides the same effect as that of the above embodiment.

(B7) In the above embodiment, the core 10 is a core for forming the intake port in the cylinder head. However, the present disclosure is not limited to this. The present disclosure may be applied to a casting mold which uses an arbitrary core such as a core for forming the intake port in the cylinder head, a core for forming an EGR, or a core for forming a water jacket.

The present disclosure is not limited to the above embodiment, and may be realized by various configurations without departing from the gist of the present disclosure. For example, a technical feature in each embodiment corresponding to a technical feature of each aspect described in the summary may be replaced or combined as appropriate to solve part or entirety of the above-described problem or achieve part or entirety of the above-described effect. Furthermore, unless each technical feature is described as indispensable in this description, each technical features can be deleted as appropriate. For example, the present disclosure may be realized by aspects described below.

(1) One aspect of the present disclosure provides a casting mold that includes an upper mold, a lower mold, a horizontal mold and a core. In this casting mold, the core includes a main body part, and a baseboard part that continues to the main body part, the lower mold includes an accommodation part that accommodates the baseboard part, and the casting mold further includes an urging member that urges the baseboard part toward an inner face of the accommodation part.

The casting mold according to this aspect includes the urging member which urges the baseboard part toward the inner face of the accommodation part, so that it is possible to press the baseboard part against the accommodation part. Consequently, it is possible to prevent positional displacement of the core due to buoyance of the molten metal by using a friction force between the baseboard part and the accommodation part, easily prevent the positional displacement of the core, and reduce the operator's burden.

(2) In the casting mold according to the above aspect, the urging member may include a pin member that has one end in contact with the baseboard part, and a spring arranged on an other end side opposite to a side of the pin member that is in contact with the baseboard part, and urges the pin member toward the baseboard part.

According to the casting mold according to this aspect, the urging member includes the pin member and the spring which urges the pin member toward the baseboard part, so that, even when the lower mold and the pin member age due to, for example, wear, it is possible to continuously press the baseboard part against the accommodation part. Consequently, it is possible to reduce an operator's burden required for maintenance.

(3) In the casting mold according to the above aspect, the one end of the pin member may have a semispherical external shape.

According to the casting mold according to this aspect, the external shape of the one end of the pin member which is in contact with the baseboard part has the semispherical external shape, so that it is possible to place the baseboard part and the pin member in contact in the very narrow area (so-called one point). Consequently, it is possible to substantially fix the contact position irrespectively of the posture of the baseboard part and the posture of the pin member, and press the baseboard part against the accommodation part with a stable urging force.

(4) In the casting mold according to the above aspect, a first through-hole in a horizontal direction that accommodates part of the pin member may be formed in the horizontal mold, and the casting mold may further include a plate member that has a second through-hole and that supports the lower mold from the horizontal direction, wherein the second through-hole continues to the first through-hole and accommodates the part of the pin member and the spring, and a cap member that seals an opening on a side opposite to a side of the second through-hole that continues to the first through-hole.

According to the casting mold according to this aspect, it is possible to accommodate the baseboard part in the accommodation part, insert the pin member through the opening of the plate member after closing each mold, and seal the opening by the cap member. Consequently, it is possible to avoid the pin member from bothering accommodating the baseboard part in the accommodation part.

(5) In the casting mold according to the above aspect, a protrusion part may be formed on at least one of the accommodation part and the baseboard part, the protrusion part forming one or more small clearance parts whose size of a clearance in a gap between the inner face of the accommodation part and an outer face of the baseboard part is smaller than a size of other part of the gap.

According to the casting mold according to this aspect, the protrusion parts for forming the small clearance parts are formed on at least one of the accommodation part and the baseboard part, so that it is possible to prevent positional displacement of the baseboard part in the accommodation part by using the small clearance parts, and further prevent positional displacement of the core. Furthermore, the part other than the small clearance parts of the gap has a relatively large clearance size, so that it is possible to improve operability for accommodating the baseboard part in the accommodation part.

(6) In the casting mold according to the above aspect, the main body part may include an external shape having a longitudinal direction, an upper end part of the baseboard part may be connected with the main body part at one end in the longitudinal direction of the main body part, the gap may include the small clearance parts respectively on an inner side in a horizontal direction and a lower side in a vertical direction, and on an outer side in the horizontal direction and an upper side in the vertical direction, the small clearance part on the outer side in the horizontal direction and the upper side in the vertical direction of the gap may be formed by the protrusion part formed on the accommodation part, and the pin member may come into contact with the baseboard part through the small clearance part on the outer side in the horizontal direction and the upper side in the vertical direction of the gap.

The upper end part of the baseboard part is connected with the one end in the longitudinal direction of the main body part, so that the buoyance of the molten metal tries to rotate the core about the inner side in the horizontal direction and the lower side in vertical direction of the baseboard part as the rotation center such that the outer side in the horizontal direction and the upper side in the vertical direction of the baseboard part travel downward. However, according to the casting mold according to the above aspect, the pin member comes into contact with the baseboard part through the small clearance part on the outer side in the horizontal direction and the upper side in the vertical direction of the gap, so that it is possible to more reliably prevent such rotation with a small force.

The present disclosure can be also realized by various aspects. The present disclosure can be realized by, for example, a casting method, a casting mold manufacturing method, a core fixing method and a core fixing member.

What is claimed is:

1. A casting mold comprising:
an upper mold;
a lower mold;
a horizontal mold;
a core comprising:
a main body part; and
a baseboard part that continues to the main body part,
wherein the lower mold comprises an accommodation part that accommodates the baseboard part;
an urging member that urges the baseboard part toward an inner face of the accommodation part, the urging member comprising:
a pin member that has one end that is in contact with the baseboard part; and
a spring arranged on another end side opposite to a side of the pin member that is in contact with the baseboard part, and urges the pin member toward the baseboard part,
wherein a first through-hole in a horizontal direction that accommodates part of the pin member is formed in the upper mold;
a plate member that has a second through-hole and that supports the lower mold from the horizontal direction,
wherein the second through-hole continues to the first through-hole and accommodates the part of the pin member and the spring; and
a cap member that seals an opening on a side opposite to a side of the second through-hole that continues to the first through-hole.

2. The casting mold according to claim 1, wherein the one end of the pin member has a semispherical external shape.

3. The casting mold according to claim 1, wherein a protrusion part is formed on at least one of the accommodation part and the baseboard part, the protrusion part forming one or more clearance parts whose size of a clearance in a gap between the inner face of the accommodation part and an outer face of the baseboard part is smaller than a size of another part of the gap.

4. The casting mold according to claim 3, wherein
the main body part includes an external shape having a longitudinal direction,
an upper end part of the baseboard part is connected with the main body part at one end in the longitudinal direction of the main body part,
the gap includes the clearance parts respectively on an inner side in a horizontal direction and a lower side in a vertical direction, and on an outer side in the horizontal direction and an upper side in the vertical direction, the clearance part on the outer side in the horizontal direction and the upper side in the vertical direction of the gap is formed by the protrusion part formed on the accommodation part, and the pin member comes into contact with the baseboard part through the clearance part on the outer side in the horizontal direction and the upper side in the vertical direction of the gap.

* * * * *